US008714382B2

(12) United States Patent
Escobar et al.

(10) Patent No.: US 8,714,382 B2
(45) Date of Patent: May 6, 2014

(54) COMPOSITE INTERLOCKING STOPPER AND METHOD OF MANUFACTURE

(75) Inventors: Miguel F. Escobar, Mexico D.F. (MX); Ricardo Escobar, Mexico D.F. (MX)

(73) Assignee: Tapones Escobar, S.A. (MX)

( * ) Notice: Subject to any disclaimer, the term of this patent is extended or adjusted under 35 U.S.C. 154(b) by 0 days.

(21) Appl. No.: 12/914,229

(22) Filed: Oct. 28, 2010

(65) Prior Publication Data

US 2011/0036805 A1 Feb. 17, 2011

Related U.S. Application Data

(63) Continuation-in-part of application No. 12/842,091, filed on Jul. 23, 2010.

(60) Provisional application No. 61/256,388, filed on Oct. 30, 2009, provisional application No. 61/228,324, filed on Jul. 24, 2009.

(51) Int. Cl.
*B65D 39/00* (2006.01)
*B65D 39/16* (2006.01)

(52) U.S. Cl.
USPC ..... 215/364; 215/355

(58) Field of Classification Search
USPC ..... 215/355, 365, 296, 297; 264/274
See application file for complete search history.

(56) References Cited

U.S. PATENT DOCUMENTS

| | | | | |
|---|---|---|---|---|
| 2,046,224 | A * | 6/1936 | Vanderhoof | 215/296 |
| 2,095,272 | A * | 10/1937 | Vanderhoof | 215/296 |
| 4,483,451 | A * | 11/1984 | Gorski | 215/296 |
| 4,889,251 | A | 12/1989 | Hojnoski | |
| 5,636,757 | A * | 6/1997 | Porvaznik | 215/364 |
| 6,168,036 | B1 * | 1/2001 | Teng | 215/296 |
| 2002/0153342 | A1 * | 10/2002 | Fragola | 215/364 |
| 2004/0112856 | A1 * | 6/2004 | Hwang et al. | 215/361 |
| 2004/0169001 | A1 * | 9/2004 | Leendersten et al. | 215/355 |
| 2004/0232102 | A1 * | 11/2004 | Gardner et al. | 215/299 |
| 2004/0238479 | A1 * | 12/2004 | Caswell et al. | 215/364 |
| 2006/0231520 | A1 * | 10/2006 | Van Cromvoirt | 215/355 |
| 2007/0272650 | A1 * | 11/2007 | Kishi et al. | 215/364 |
| 2008/0116165 | A1 * | 5/2008 | Lin | 215/294 |

FOREIGN PATENT DOCUMENTS

| | | | |
|---|---|---|---|
| DE | 202004016818 | U1 | 4/2005 |
| DE | 102004034709 | B3 | 2/2006 |
| EP | 2277791 | | 1/2011 |
| FR | 1221748 | A | 6/1960 |
| GB | 2405144 | A | 2/2005 |
| JP | 2001048204 | A | 2/2001 |

(Continued)

OTHER PUBLICATIONS

European Search Report for Application No. 10170616 dated Sep. 2, 2010, 6 pages.

(Continued)

*Primary Examiner* — Anthony Stashick
*Assistant Examiner* — Niki Eloshway
(74) *Attorney, Agent, or Firm* — Cantor Colburn LLP

(57) ABSTRACT

A composite synthetic cork is provided, wherein the synthetic cork is operatively coupled with a cap via an interlocking contour. In an exemplary embodiment, the interlocking contour(s) is molded on or within an otherwise flat bottom portion of the cap. In other exemplary embodiments, the cap and the cork are assembled via co-injection molding.

9 Claims, 4 Drawing Sheets

(56) References Cited

FOREIGN PATENT DOCUMENTS

| | | | |
|---|---|---|---|
| WO | W09901354 | A1 | 1/1999 |
| WO | W02004024585 | A1 | 3/2004 |
| WO | W02010078417 | | 7/2010 |

OTHER PUBLICATIONS

Notice of Allowance for EP Application No. 101707616.6 dated Dec. 23, 2011, 4 pages.

European Search Report for Application No. 10189621.5 dated Feb. 9, 2011, 9 pages.

* cited by examiner

COMPOSITE INTERLOCKING STOPPER AND METHOD OF MANUFACTURE

CROSS REFERENCE TO RELATED APPLICATIONS

The present application claims priority to U.S. Provisional Patent Application Ser. No. 61/256,388 filed Oct. 30, 2009, and is a Continuation-In-Part of U.S. patent application Ser. No. 12/842,091 filed Jul. 23, 2010, which claims priority to U.S. Provisional Patent Application Ser. No. 61/228,324 filed Jul. 24, 2009, the entire contents each of which are specifically incorporated by reference herein.

BACKGROUND

The present disclosure relates to container closures including a cork material interlocked with a handle or cap (hereinafter referred to as a cap).

Producers of liquid consumable products, such as wine, liquor and other products, that are sold in bottles or other containers that are traditionally closed and sealed with cork stoppers have long been concerned about the reliability and structural integrity of the cork and cap, particularly along the interface of the two. Traditional models use glue to bond the cork to the cap. However, breakage of the bond remains a significant concern in the industry.

Accordingly, there is a need in the industry for a more reliable bond between the cork and the cap.

SUMMARY

The present stopper comprises a cork portion that is bonded to a cap portion via an interlocking interface. In an exemplary embodiment, the cork material is a synthetic cork material. In another exemplary embodiment, the cork material is injection molded over a portion of the cap, which portion includes surface contouring that provides more surface area for the cork to cap bond.

In another exemplary embodiment, a first cap portion contour creates a mechanical interlock that resists relative movement of the cork and the cap in a first direction. In another exemplary embodiment, a second cap portion contour creates a mechanical interlock that resists relative movement of the cork and the cap in a second direction.

In other exemplary embodiments, a first cap portion contour creates a mechanical interlock that resists separation of the cork and the cap. In other exemplary embodiments, a first cap portion contour creates a mechanical interlock that resists rotation of the cork relative to the cap. In other exemplary embodiments, a first cap portion contour creates a mechanical interlock that resists separation of the cork and the cap and rotation of the cork relative to the cap.

BRIEF DESCRIPTION OF THE DRAWINGS

Referring now to the drawings, wherein like elements are numbered alike in the following FIGURES.

DETAILED DESCRIPTION

As was noted above, the present disclosure relates to a stopper, comprising a cork portion that is bonded to a cap portion via an interlocking interface.

Figure 1:
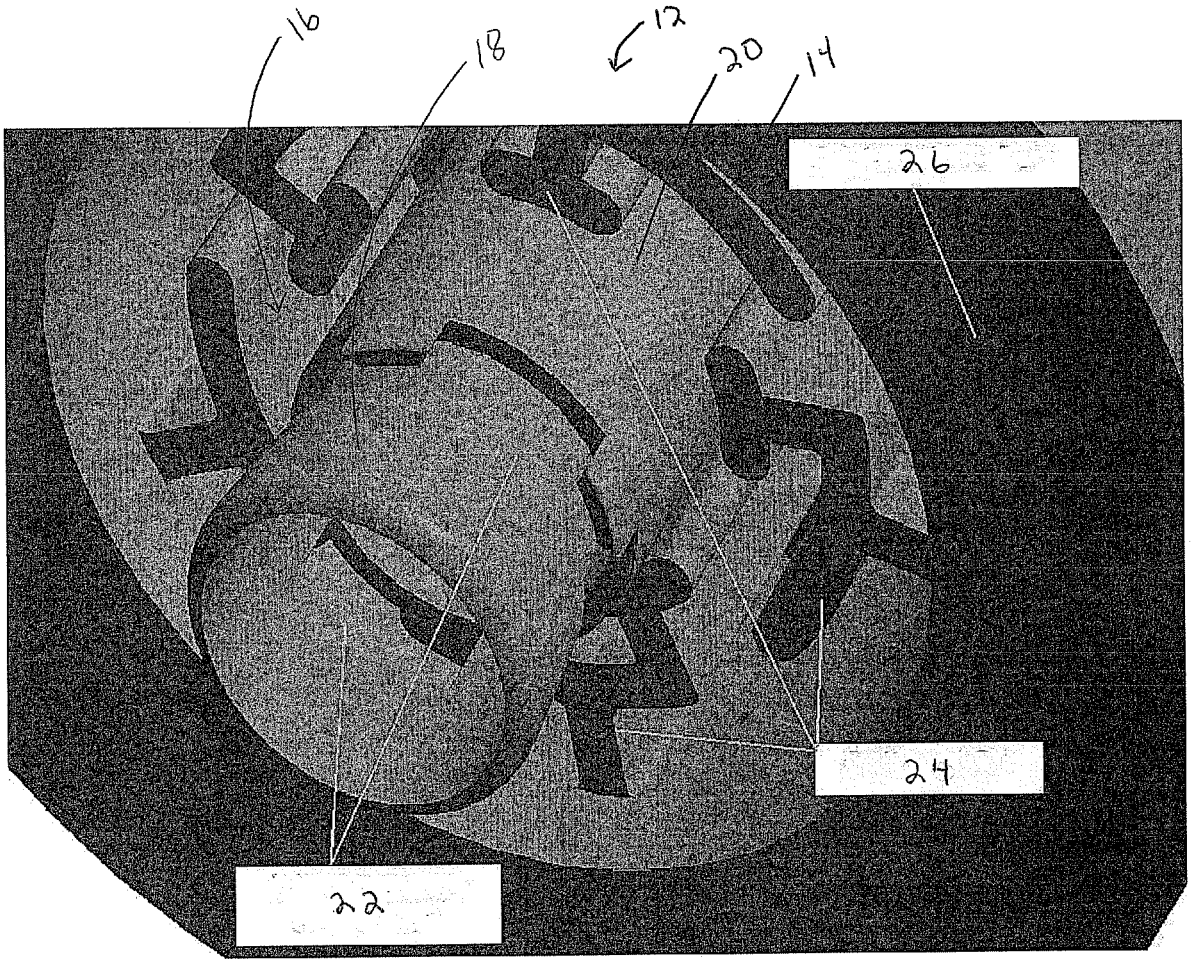
FIG. 1 is perspective view of an exemplary cap.
Figure 2:
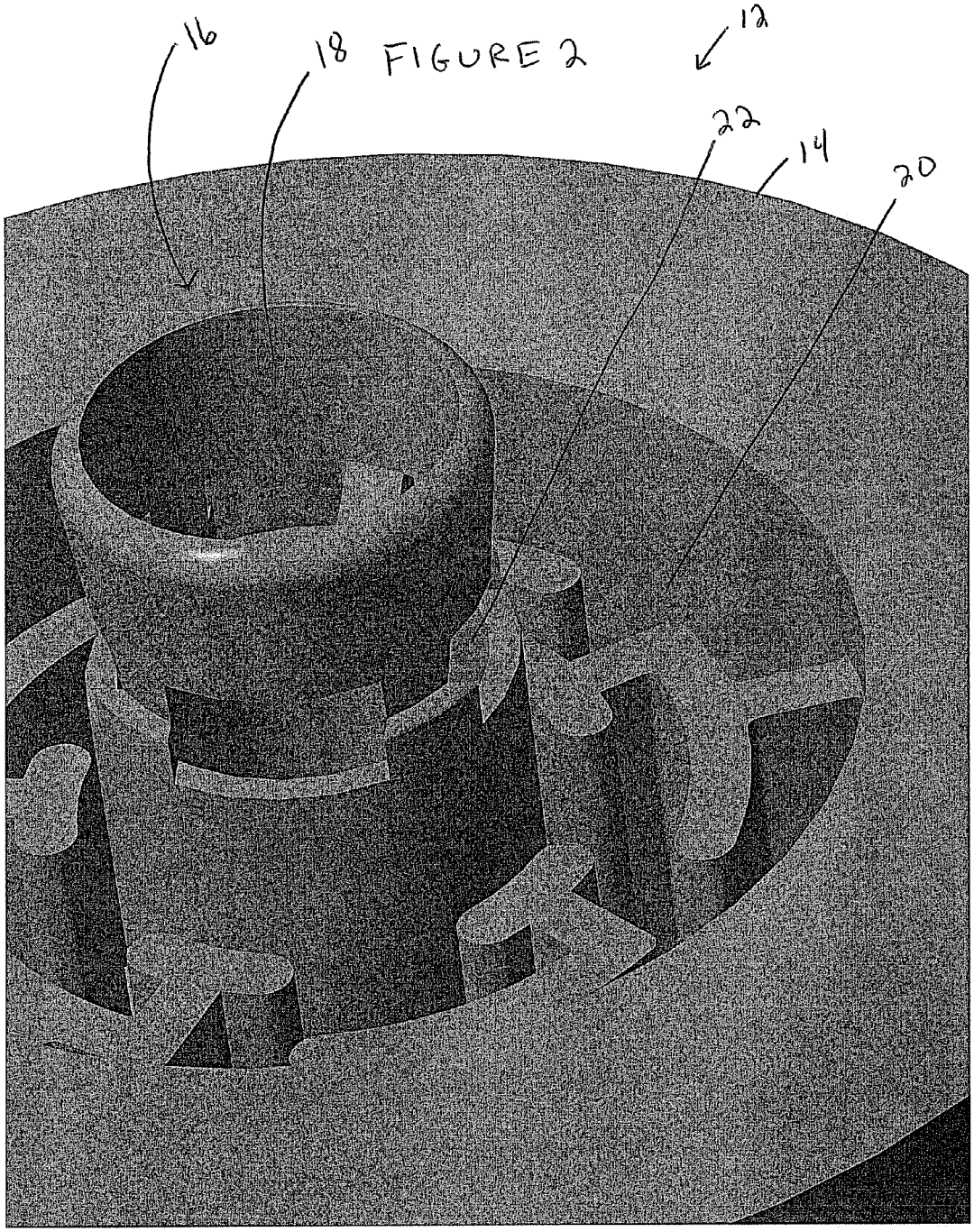
FIG. 2 is another perspective view of the exemplary cap of FIG. 1.
Figure 3:
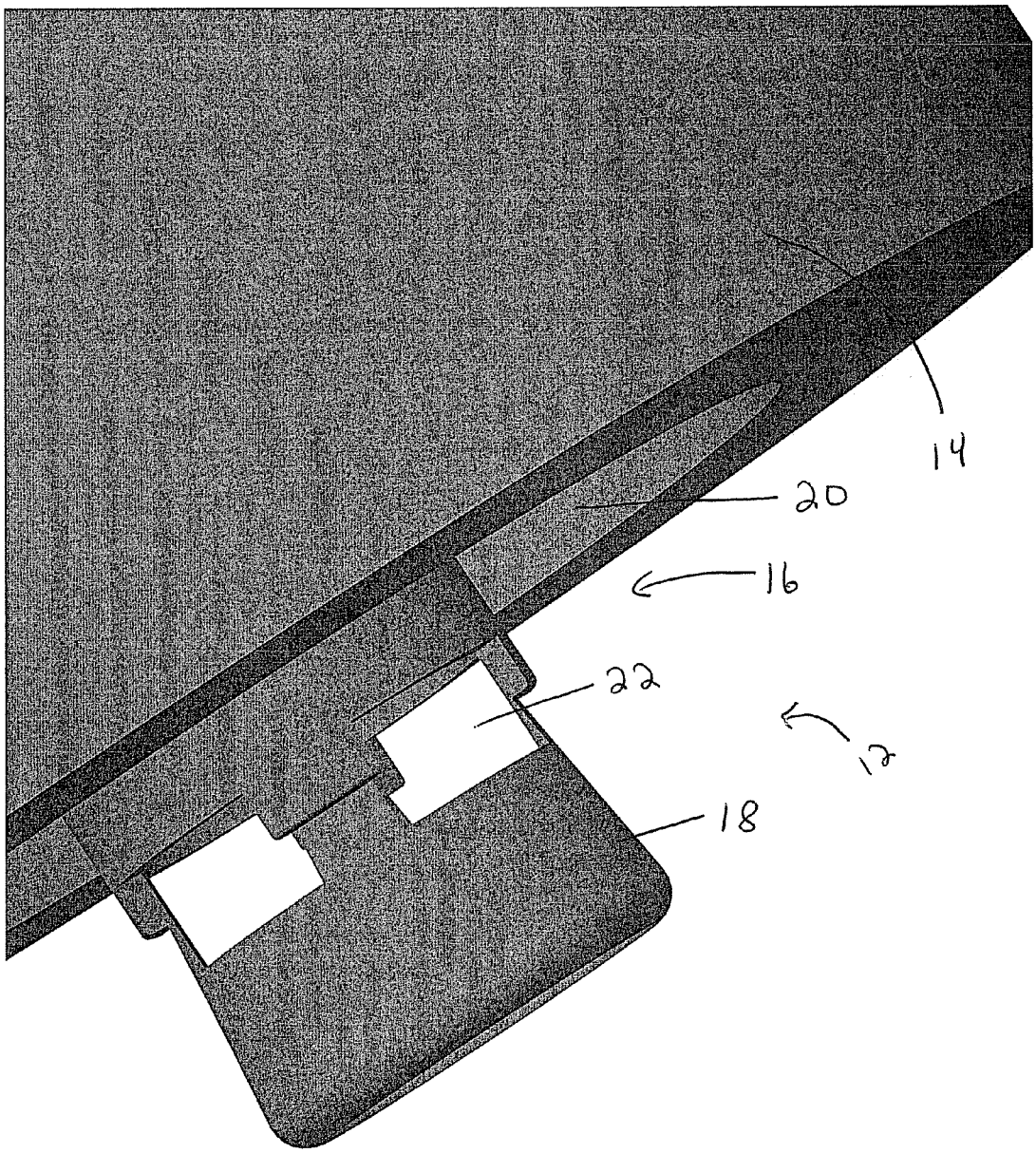
FIG. 3 is a side elevation view of the exemplary cap of FIG. 1.

Referring now to FIGS. 1-3, an exemplary cap is shown generally at 12. The cap includes a handle portion 14 and a cork interface portion, shown generally at 16. As is illustrated in FIGS. 1-3, the cork interface portion includes at least one contour that provides more surface area for the cork to cap bond. The illustrated exemplary cork interface portion includes a pin contour 18, a groove contour 20 on the pin contour 18, a hole contour 22 within the pin contour 18, and a plurality of fin contours 24 within the groove contour. The handle portion includes a generally flat surface 26 configured to interface with cork material in circumstances where the cork diameter exceeds the diameter of the groove contour 20.

Figure 4:
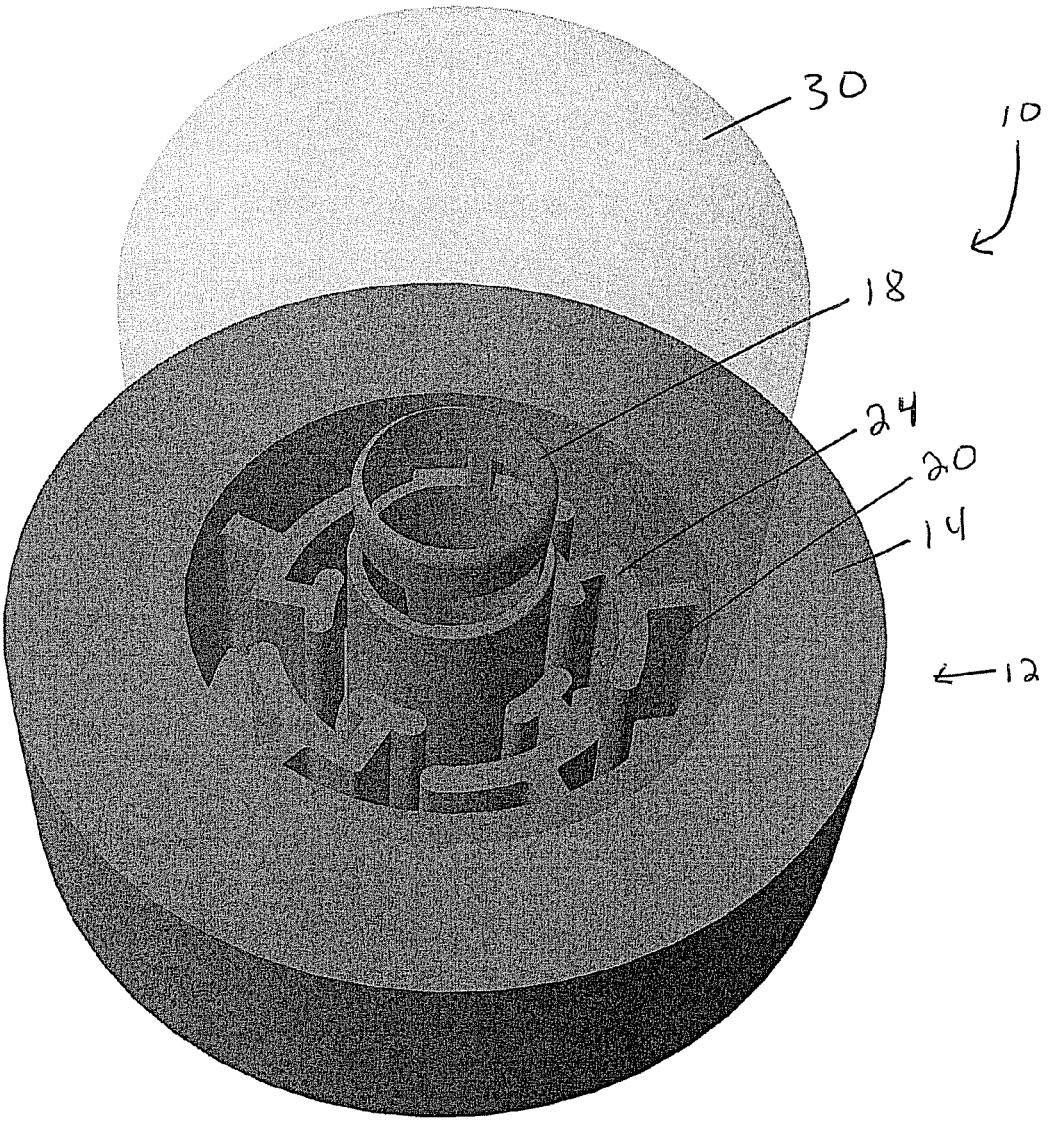
FIG. 4 is a perspective view of an exemplary stopper.

Referring now to FIG. 4, an exemplary stopper is illustrated generally at 10. The exemplary stopper includes the exemplary elements of FIGS. 1-3 with a cork material 30 bonded thereto. In an exemplary embodiment, the cork material is a synthetic cork material. In another exemplary embodiment, the cork material is injection molded over the cork interface portion. In another exemplary embodiment, the cap and cork material are co-injected during assembly. In molding certain contours of the cap portion (e.g., grooves, holes or fins), sliders may be used in the mold to release such contours. However, in certain embodiments, sliders are not necessary for molding of the cap portion (for example, with reference to the exemplary embodiment of FIG. 2, the material of the pin contour is arranged such that a mold would not require sliders to generate the hole contours 22).

In another exemplary embodiment, a first cap portion contour creates a mechanical interlock that resists relative movement of the cork and the cap in a first direction. It is noted that each of the described contours resists relative movement of the cork and the cap in at least one direction. For example, the pin contour 18 resists bending of the cork material 30 off of its longitudinal axis. The groove 20 contour further resists bending of the cork material (by incorporation of the cork material past the flat surface 26 of the handle portion into the groove 20. The fin contours 24 within the groove 20 increase the bonding area between the cap and cork and resist rotation of the cork 30 about the pin contour 18. The hole contours 22 resist both pulling of the cork 30 away from the bottom 26 of the cap 12 and rotation of the cork 30 about the pin contour 18. Thus, various cap portion contours create a mechanical interlock that resist relative movement of the cork and the cap in at least one direction.

It will be apparent to those skilled in the art that, while exemplary embodiments have been shown and described, various modifications and variations can be made to the synthetic cork and method of making disclosed herein without departing from the spirit or scope of the invention. For example, recitations of contours, including projections and recesses, are non-limiting. The cap interface portion may include a single or a combination of contours providing a mechanical interlock. Additionally, various amounts of cork (e.g., widths) may be used such that the cork covers only a portion or, e.g., all of the bottom surface of the cap handle. Accordingly, it is to be understood that the various embodiments have been described by way of illustration and not limitation.

What is claimed is:

1. A stopper, comprising:

a cap, including a handle portion, a bottom portion and at least one contour dependent from said bottom portion, wherein said bottom portion comprises a pin contour including a hole contour provided through a side portion of said pin contour, the at least one contour providing increased surface area relative to said bottom portion; and a cork portion that is bonded to a portion of the cap via an interlocking interface provided by said at least one contour, the interlocking interface resisting relative movement of the assembled cap and cork in at least one direction, wherein the hole contour is configured to resist rotation and separation of cork material bonded to the surface of the pin contour adjacent to the hole contour via co-injection of the cork material with or injection molding of the cork material over said pin contour and through said hole contour.

2. A stopper in accordance with claim 1, further comprising, an additional cap portion contour configured to create a second mechanical interlock that resists relative movement of the cork and the cap in a at least one direction.

3. A stopper in accordance with claim 2, wherein said additional cap portion contour resists separation of the cork and the cap.

4. A stopper in accordance with claim 2, wherein said additional cap portion contour resists rotation of the cork relative to the cap.

5. A stopper in accordance with claim 2, wherein said additional cap contour comprises one or both of a groove and a fin.

6. A stopper in accordance with claim 1, wherein said cork material is a synthetic cork material.

7. A method of manufacturing a stopper, comprising:

injection molding a cap, including a handle portion, a bottom portion and at least one contour dependent from said bottom portion, pin contour including a hole contour provided through a side portion of said pin contour, the at least one contour providing increased surface area relative to said bottom portion; and injection molding a cork portion around said a cork interface portion of said cap to bond said cork to a portion of the cap via an interlocking interface provided by said at least one contour, the interlocking interface resisting relative movement of the assembled cap and cork in at least one direction, wherein the hole contour is configured to resist rotation and separation of cork material bonded to the surface of the pin contour adjacent to the hole contour and through said hole contour.

8. A stopper in accordance with claim 1, wherein said hole contour comprises multiple holes through said pin contour.

9. A method in accordance with claim 7, wherein said hole contour comprises multiple holes through said pin contour.

* * * * *